US008597439B2

(12) United States Patent
Ikeda et al.

(10) Patent No.: US 8,597,439 B2
(45) Date of Patent: Dec. 3, 2013

(54) HIGH-STRENGTH COLD ROLLED STEEL SHEET HAVING EXCELLENT FORMABILITY, AND PLATED STEEL SHEET

(75) Inventors: Shushi Ikeda, Kobe (JP); Yoichi Mukai, Kakogawa (JP); Hiroshi Akamizu, Kobe (JP); Koichi Makii, Kobe (JP); Koichi Sugimoto, Ueda (JP); Shunichi Hashimoto, Minato (JP); Kenji Saito, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 701 days.

(21) Appl. No.: 12/640,229

(22) Filed: Dec. 17, 2009

(65) Prior Publication Data

US 2010/0092332 A1 Apr. 15, 2010

Related U.S. Application Data

(63) Continuation of application No. 11/110,716, filed on Apr. 21, 2005, now abandoned.

(30) Foreign Application Priority Data

Apr. 22, 2004 (JP) ..... P2004-126916

(51) Int. Cl.
*C22C 38/12* (2006.01)

(52) U.S. Cl.
USPC ..... 148/320

(58) Field of Classification Search
USPC ..... 148/320
See application file for complete search history.

(56) References Cited

U.S. PATENT DOCUMENTS

| | | | |
|---|---|---|---|
| 5,328,528 | A | 7/1994 | Chen |
| 6,306,527 | B1 | 10/2001 | Ikeda et al. |
| 6,316,127 | B1 | 11/2001 | Ikeda et al. |
| 2003/0084966 | A1 | 5/2003 | Ikeda et al. |
| 2004/0007298 | A1 | 1/2004 | Akamizu et al. |
| 2004/0035500 | A1 | 2/2004 | Ikeda et al. |
| 2004/0074575 | A1 | 4/2004 | Kashima et al. |
| 2004/0159373 | A1 | 8/2004 | Ikeda et al. |
| 2004/0226635 | A1 | 11/2004 | Ikeda et al. |
| 2006/0081312 | A1 | 4/2006 | Yokoi et al. |

FOREIGN PATENT DOCUMENTS

EP 1 382 702 A1 1/2004

OTHER PUBLICATIONS

T. Yamada, et al., "The Mixed Structure with Bainite and Retained Austenite in a Si-Mn Steel-1-", Nisshin Steel Technical Report, vol. 43, pp. 1-10 (Dec. 1980) (with English synopsis).

K. Sugimoto, et al., "Current Advances in Materials and Processes", Lecture Articles of the Iron and Steel Institute of Japan, vol. 17, No. 3, p. 500 (2004) (with English translation).

(Continued)

*Primary Examiner* — Sikyin Ip

(74) *Attorney, Agent, or Firm* — Oblon, Spivak, McClelland, Maier & Neustadt, L.L.P.

(57) ABSTRACT

A high-strength cold rolled steel sheet contains:
0.10 to 0.28% of C,
1.0 to 2.0% of Si,
1.0 to 3.0% of Mn, and
0.03 to 0.10% of Nb in terms of % by mass,
Al is controlled to 0.5 or less, P is controlled to 0.15% or less, and S is controlled to 0.02% or less, and residual austenite accounts for 5 to 20%, bainitic ferrite accounts for 50% or more, and polygonal ferrite accounts for 30% or less (containing 0%), of the entire structure, and a mean number of residual austenite blocks is 20 or more as determined when the random area (15 μm×15 μm) is observed by EBSP (electron back scatter diffraction pattern).

16 Claims, 6 Drawing Sheets

(56) References Cited

OTHER PUBLICATIONS

K. Sugimoto, et al., "Retained Austenite Characteristics and Stretch-flangeability of High-Strength Low-alloy TRiP Type Bainitic Sheet Steels", ISIJ International. vol. 42, No. 4, XP-001182012, pp. 450-455 (2002).

K. Sugimoto, et al., "Stretch-flangeability of a high-strength TRiP Type Bainitic Sheet Steel", ISIJ Internation, vol. 40, No. 9, XP-001182010, pp. 920-926 (2000).

K. Sugimoto, et al., Retained Austenite Characteristics and Tensite Properties in a TRiP Type Bainitic Sheet Steel, ISIJ International, vol. 40, No. 9, XP-009048166, pp. 902-908 (2000).

No.5
Example of the present invention

No.12
Comparative Example

No.5 Example of the present invention (a) Photograph of EBSP without any processing 7.50 μm = 50 steps IQ 21.342...162.483, Phase (b) Photograph of EBSP after omitting data having CI of 0.2 or less Position where CI Is 0.2 or less

PF 7.50 μm = 50 steps IQ 24.932...162.483, Phase

Sheet Thikness : 1.2mm

HIGH-STRENGTH COLD ROLLED STEEL SHEET HAVING EXCELLENT FORMABILITY, AND PLATED STEEL SHEET

CROSS-REFERENCE TO RELATED APPLICATIONS

This is a continuation application of U.S. application Ser. No. 11/110,716, filed Apr. 21, 2005, now abandoned.

BACKGROUND OF THE INVENTION

1. Technical Field

The present invention relates to a high-strength cold rolled steel sheet having excellent formability, and a plated steel sheet. More particularly, it relates to a high-strength cold rolled steel sheet that has "excellent formability" in such a sense that it has well-balanced tensile strength and elongation (total elongation) as well as well-balanced tensile strength and stretch-flangeability, and a plated steel sheet manufactured by plating the steel sheet. More specifically, the high-strength cold rolled steel sheet or plated steel sheet of the present invention satisfies that the product of tensile strength [TS (MPa)] and elongation [El (%)] is 20,000 or more and the product of tensile strength [TS (MPa)] and stretch-flangeability [λ(%)] is 40,000 or more.

The steel sheet described above can be utilized in wide fields of industry including automobile, electric apparatuses and machinery. Description that follows will deal with a case of using the steel sheet of the present invention in the manufacture of automobile bodies, as a typical application.

2. Background Art

There are increasing demands for high-strength steel sheets for the purpose of improving the fuel efficiency through mass reduction of the steel sheets used in automobiles and improving the safety in the event of collision. Recently, calls for the reduction of exhaust gas emission based on concerns about the global environment add to the demands.

However, high-strength steel sheets are still required to have excellent formability, so as to be formed in various shapes in accordance to the application. In an application where the steel sheet is pressed into a complicated shape, in particular, there is a strong demand for a high-strength steel sheet that combines satisfactory elongation property and stretch-flangeability.

As a high-strength steel sheet having excellent ductility, a TRIP (transformation induced plasticity) steel sheet has attracted special interest recently. The TRIP steel sheet includes residual austenite structure and, when processed to deform at a temperature higher than the martensitic transformation start point (Ms point), undergoes considerable elongation due to induced transformation of the residual austenite (γR) into martensite by the action of stress. Known examples include TRIP type composite-structure steel (TPF steel) that consists of polygonal ferrite as the matrix phase and residual austenite; TRIP type tempered martensite steel (TAM steel) that consists of tempered martensite as the matrix phase and residual austenite; and TRIP type bainitic ferrite steel (TBF steel) that consists of bainitic ferrite as the matrix phase and residual austenite.

Among these, the TBF steel has long been known (described, for example, in Non-Patent Document 1), and has such advantages as the capability to readily provides high strength due to the hard bainitic ferrite structure, and the capability to show outstanding elongation because fine residual austenite grains can be easily formed in the boundary of lath-shaped bainitic ferrite in the bainitic ferrite structure. The TBF steel also has such an advantage related to manufacturing, that it can be easily manufactured by a single heat treatment process (continuous annealing process or plating process).

In a conventional TBF steel, however, satisfactory characteristics have never been attained in stretch-flangeability. The present inventors have recently disclosed, as high-strength/ultrahigh-strength steel sheets that combines high strength and excellent stretch-flangeability, an Al—Mn-based BF steel sheet manufactured by substituting Si with Al and an Al—Mn—Nb—Mo-based TBF steel sheet (Non-Patent Document 2) manufactured by simultaneously adding Nb and Mo to the steel sheet. However, further improvements in characteristics are required in a TBF steel sheet manufactured by the addition of Si of the prior art.

[Non-Patent Document 1] NISSHIN STEEL TECHNICAL REPORT No. 43, December, 1980, p. 1-10)

[Non-Patent Document 2] Akihiko NAGASAKA and five others, "Formability for Forming of Nb—Mo-added TRIP type Bainitic Ferrite Steel Sheet", CAMP-ISIJ, 2004, Vo. 17, p. 500

THE SUMMARY OF THE INVENTION

Disclosure of the Invention

Problems to be Solved by the Invention

The present invention has been made with the background described above, and an object thereof is to provide a high-strength cold rolled steel sheet that has well-balanced tensile strength and elongation as well as well-balanced tensile strength and stretch-flangeability, and a plated steel sheet manufactured by plating the steel sheet.

Means for Solving the Problems

The high-strength cold rolled steel sheet having excellent formability of the present invention is characterized in that it contains:

0.10 to 0.28% of C,
1.0 to 2.0% of Si,
1.0 to 3.0% of Mn, and
0.03 to 0.10% of Nb in terms of % by mass,
wherein the content of Al is controlled to 0.5 or less,
the content of P is controlled to 0.15% or less, and
the content of S is controlled to 0.02% or less,
and wherein residual austenite accounts for 5 to 20%,
bainitic ferrite accounts for 50% or more, and
polygonal ferrite accounts for 30% or less (containing 0%), of the entire structure,
and wherein a mean number of residual austenite blocks is 20 or more as determined when the random area (15 μm×15 μm) is observed by EBSP (electron back scatter diffraction pattern).

In the preferred high-strength cold rolled steel sheet, a first embodiment may further contain at least one element selected from the group consisting of 1.0% or less (more than 0%) of Mo,
0.5% or less (more than 0%) of Ni, and
0.5% or less (more than 0%) of Cu;

A second preferred embodiment of high-strength cold rolled steel sheet, may further contain 0.003% or less (more than 0%) of Ca and/or 0.003% or less (more than 0%) of REM; and Another preferred embodiment of high-strength cold rolled steel sheet, may further contain 0.1% or less (more than 0%) of Ti and/or 0.1% or less (more than 0%) of V.

A plated steel sheet manufactured by plating the steel sheet is also included in the present invention, in addition to the above cold rolled steel sheets.

Effect of the Invention

According to the present invention, there can be provided a high-strength cold rolled steel sheet that satisfies that the product of tensile strength [TS (MPa)] and elongation [El (%)] is 20,000 or more and the product of tensile strength [TS (MPa)] and stretch-flangeability [λ(%)] is 40,000 or more, and has well-balanced tensile strength and elongation (total elongation) as well as well-balanced tensile strength and stretch-flangeability, and a plated steel sheet. These cold-rolled steel sheets can be used with high formability in the manufacture of automobile parts and industrial machine parts that require high strength.

BRIEF DESCRIPTION OF THE DRAWINGS

Other objects and advantages of the invention will become apparent during the following discussion of the accompanying drawings, wherein.

DETAILED DESCRIPTION OF THE PREFERRED EMBODIMENTS

Figure 1:
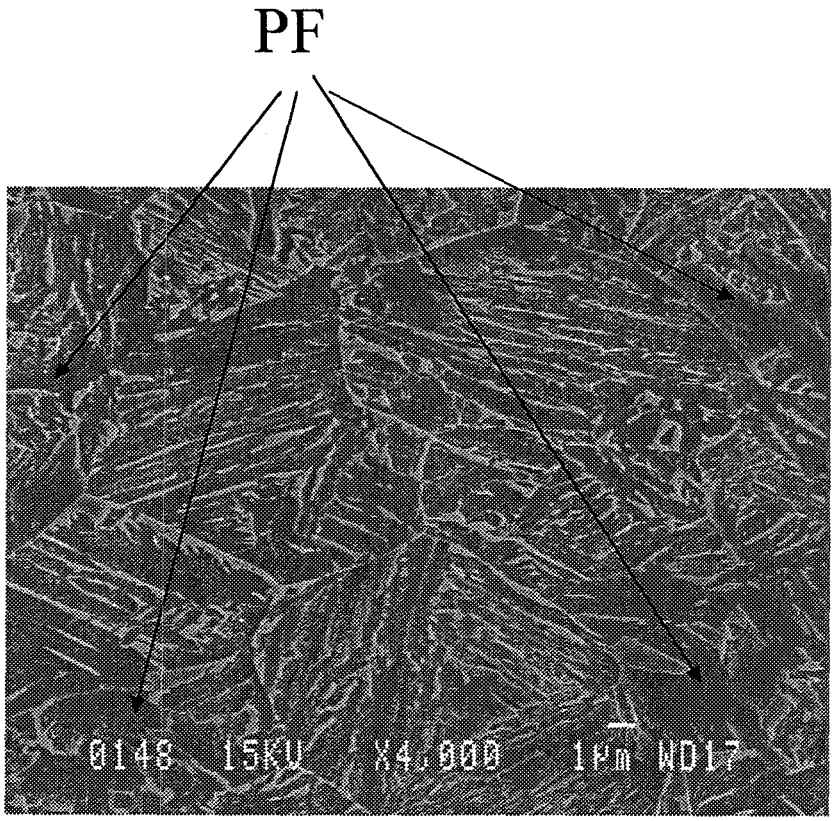
FIG. 1 is a SEM photograph (magnification factor 4000) of No. 5 (example of the present invention) of Example 1.

Best Mode for Carrying Out the Invention

To provide a high-strength cold rolled steel sheet that has well-balanced tensile strength and elongation as well as well-balanced tensile strength and stretch-flangeability, and a plated steel sheet, the present inventors took up a TBF steel and conducted a research. Reasons for taking up the TBF steel in the present invention are as described above. The present inventors took up the cold rolled steel sheet among steel sheets in consideration of the following actual circumstances. That is, the cold rolled steel sheet has a small thickness and high accuracy of surface quality as compared with a hot rolled sheet and is therefore greatly required as the material for automobile bodies. However, it tends to be inferior in elongation and stretch-flangeability because of small thickness, and thus a cold rolled steel sheet having excellent formability has never been provided.

As a result, the present inventors have found that (1) creation of polygonal ferrite is suppressed as possible so as to enhance balance between elongation and stretch-flangeability of a high-strength steel sheet and to surely enhance stretch-flangeability of the steel sheet by employing a TRIP steel sheet that consists of a bainitic ferrite as the matrix phase and residual austenite (residual γ); (2) Nb may be positively added in the steel thereby to refine the residual austenite (residual γ) as the second phase in order to remarkably enhance balance between tensile strength and stretch-flangeability; and (3) a slab temperature (SRT) at the starting of hot rolling in a hot rolling step may be controlled to higher temperature (1250 to 1350° C.) than that in the method of the prior art using a Nb-added steel containing a predetermined amount of Nb in order to make full use of the effect due to the addition of Nb.

Micro structure that characterizes the present invention most will be first described.

Bainitic Ferrite: At Least 50%

The steel sheet of the present invention contains residual austenite as the second phase described hereinafter and is constituted mainly from a metal structure based on bainitic ferrite (therefore the smaller the proportion of polygonal ferrite described hereinafter, the better, and the proportion of the polygonal ferrite may be 0%).

The bainitic ferrite in the present invention is obviously different from bainite structure in that there is no carbide contained therein. The bainitic ferrite refers to plate-shaped ferrite in lower structure having higher density of dislocations (which may or may not have lath-shaped structure), and is clearly distinguished from polygonal ferrite structure that has lower structure having very low or zero density of dislocation and polygonal ferrite structure that has lower structure such as fine sub-grains (refer to "Photo Library-1 of Bainite in Steel" published by The Iron and Steel Institute of Japan, Basic Research Group) by SEM observation.

Polygonal ferrite: black polygonal spots seen in SEM photograph, that do not include residual austenite or martensite therein.

Bainitic ferrite: dark gray spots that often cannot be distinguished from residual austenite or martensite in SEM photograph.

The TRIP steel sheet constituted mainly from bainitic ferrite of the present invention is clearly different from the TRIP steel sheet constituted mainly from polygonal ferrite of the prior art in mechanical characteristics. In the TRIP steel sheet of the prior art, polygonal ferrite is often contained in the form of blocks, resulting in a problem that island-like residual γ existing in boundaries of the bainitic ferrite blocks acts as the initiating point of destruction, thus making it impossible to ensure satisfactory stretch-flangeability. The metal structure that is based on bainitic ferrite according to the present invention, in contrast, can easily achieve high strength and high stretch-flangeability because of high density of dislocations (initial dislocation density). Moreover, an austempering treatment described hereinafter decreases the dislocation density to a level lower than that of the conventional bainitic ferrite. Thus it is made possible to make a steel sheet that has sufficiently low yield ratio by controlling the dislocation density to a relatively low level among various types of bainitic ferrite.

In order to achieve such an effect due to bainitic ferrite, it is necessary to have bainitic ferrite occupying at least 50%, preferably 70% or more, and more preferably 80% or more of the structure. In order to suppress the creation of ferrite and make a steel sheet having satisfactory stretch-flangeability, it is recommended to control the structure so as to be constituted from substantially two phases of bainitic ferrite and residual γ.

Residual Austenite (Residual γ): 5 to 20%

The residual γ is an essential structure for achieving the TRIP (train-induced transformation processing) characteristics and is effective in improving the elongation property. In order to make full use of this effect, the areal ratio of residual γ is controlled to be 5% or more of the entire structure. To secure more excellent ductility (e.g. elongation), the real ratio of residual γ is preferably controlled to be 7% or more. Since excessive content of residual austenite deteriorates local formability and flangeability, it is recommended to keep the content within an upper limit of 20%, and more preferably 17%.

The content of C ($C_{\gamma R}$) in the residual γ is preferably 0.8% or more. The value of $C_{\gamma R}$ has a great influence on the TRIP characteristics, and is effective in improving the elongation property when it is controlled to 0.8% or more. The content is preferably 1% or more. While the content of $C_{\gamma R}$ is preferably as high as possible, an upper limit of about 1.6% is supposedly imposed by the practical processing conditions.

Mean Number of Residual Austenite Blocks: 20 or More when Random Area (15 μm×15 μm), Excluding the Polygonal Ferrite Portion, is Observed by EBSP (Electron Back Scatter Diffraction Pattern)

In the present invention, in addition to the proportion described above, a lower limit of the mean number of the residual γ blocks observed in the random area by EBSP is defined. In other words, the fact that the mean number of the residual γ blocks satisfies the above requirements means that [very fine residual γ is included (strictly speaking, fine residual γ is included in bainitic ferrite (particularly in old austenite grains)) and such the residual γ (fine residual γ) particularly contributes to an improvement in stretch-flangeability. Actually, we have already reconfirmed in examples described hereinafter that the product of TS×λ does not satisfies a desired value (40,000 or more) when the residual γ is not obtained even if the proportion of the residual γ satisfies the scope of the present invention. According to the present invention, since the proportion of the residual γ is controlled and also fine residual γ is created, it is made possible to noticeably improve balance between tensile strength and elongation as well as balance between tensile strength and stretch-flangeability as compared with a TBF steel of the prior art.

The method for calculation of the mean number of residual γ blocks will now be described. For convenience of explanation, the method for measurement of the matrix structure (bainitic ferrite, polygonal ferrite) and the second phase structure (residual γ), that constitute the steel sheet of the present invention, will also be described.

The areal ratio of the polygonal ferrite (PF) structure and the areal ratio of the structure other than the polygonal ferrite (PF) structure (bainitic ferrite and residual γ structures; may be referred to as "structure other than PF structure") are determined by etching the surface of a steel sheet with Nital etchant and observing a surface parallel to the surface on which it was rolled at a depth of one quarter of the thickness using SEM (scanning electron microscope) (magnification factor 4000).

Figure 2:
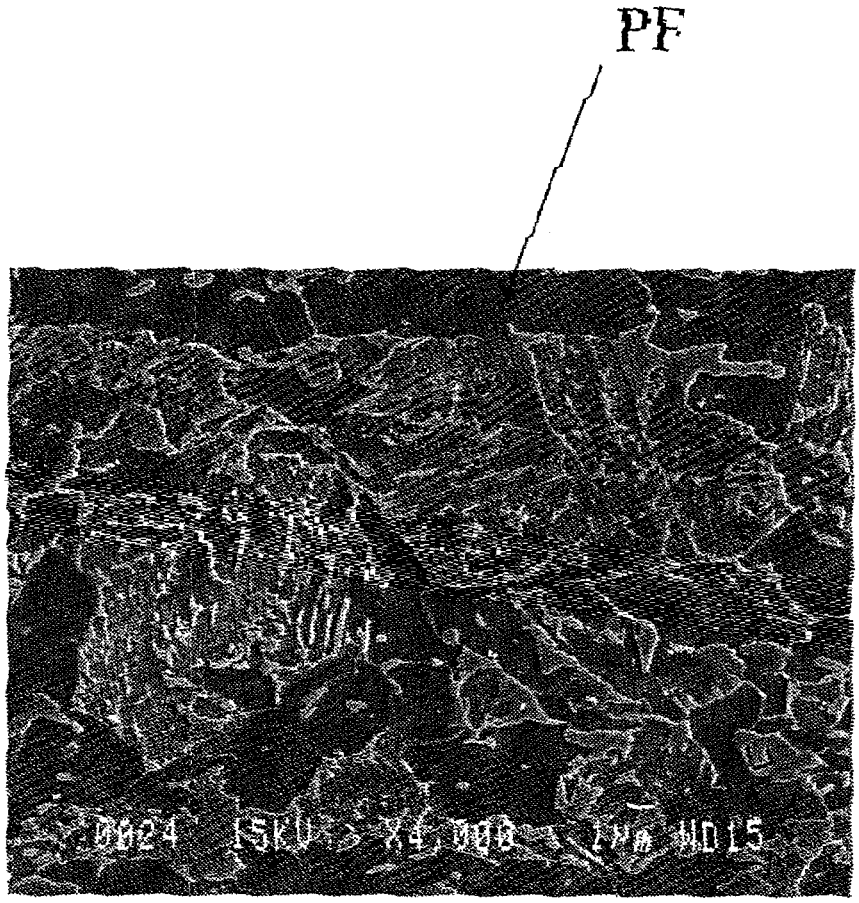
FIG. 2 is a SEM photograph (magnification factor 4000) of No. 12 (comparative example) of Example 2.

FIG. 1 and FIG. 2 show SEM photographs (magnification factor 4000) of No. 5 (example of the present invention) of Example 1 in Table 2 and No. 12 (comparative example) of Example 2 in Table 3. It is apparent that PF structure is clearly distinguished from the "structure other than PF structure" by SEM observation.

The proportion of the residual γ is measured by a saturation magnetization method [see, for example, Japanese Unexamined Patent Publication No. 2003-90825, and R&D KOBE STEEL ENGINEERING REPORTS, Vol. 52, No. 3 (December, 2002)].

The proportion of the bainitic ferrite structure is determined by subtracting the proportion (volume ratio) of the residual γ structure from the proportion of the "structure other than PF structure" determined described above.

The method for measurement of the proportion of each structure constituting the steel sheet of the present invention was described above. In the calculation of the "mean number of residual γ blocks", that characterizes the present invention, a high resolution FE-SEM equipped with an EBSP detector (Phillips' XL30S-FEG) is used, unlike the above-described method for the measurement of the proportion of the residual γ (saturation magnetization method).

Use of this FE-SEM equipment has an advantage that an area observed with the SEM can be analyzed by the EBSP detector at the same time. The EBSP method will be briefly described here. EBSP is a method of determining the crystal orientation at the position where electron beam is incident, by analyzing Kikuchi pattern obtained from reflected electrons when the electron beam is directed toward the surface of specimen. Distribution of orientations over the specimen surface can be determined by measuring the crystal orientation at predetermined pitches while scanning the specimen surface with the electron beam. The EBSP observation has such an advantage that crystal structures of different orientations in the direction of thickness, that would be regarded as identical when observed with a conventional optical microscope, can be distinguished by the color difference.

The method for the measurement of the mean number of the residual γ using the FE-SEM equipment will now be described in detail.

The specimen is electrolytic ground for the purpose of preventing the residual γ from transforming and placed in a lens barrel of the FE-SEM without being etched, and then an area (about 30×30 μm) in a surface parallel to the surface, on which it was rolled at a depth of one quarter of the thickness, is irradiated with electron beam (pitch of electron beam: 0.15 μm). Specifically, each measuring region obtained by dividing the measuring area into four (four positions measuring 15×15 μm in total) is irradiated with electron beam. EBSP image projected on a screen is captured by a high sensitivity camera (VE-1000-SIT manufactured by Dage-MIT Inc.) and is imported into a computer. The image is analyzed by the computer, and compared with a pattern generated by simulation using a known crystal system (FCC phase (face-centered cubic lattice) in the case of the residual γ) so as to color-identify the FCC phase (the residual γ is colored red, while the polygonal ferrite is colored green). Hardware and software used in the analysis described above are those of OIM (Orientation Imaging Microscopy™) system manufactured by TexSEM Laboratories Inc.

Figure 3:
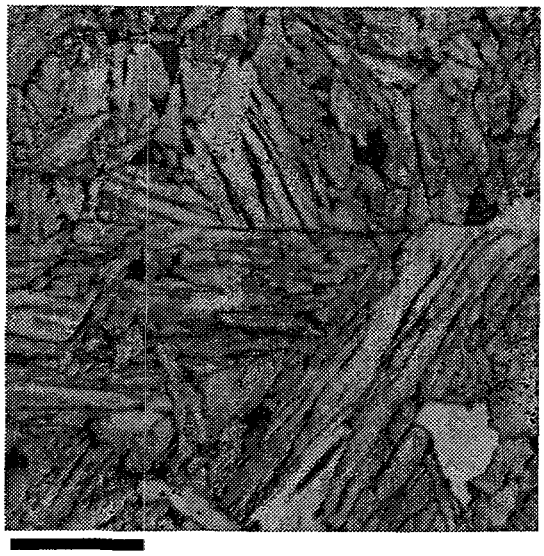
FIG. 3 is an EBSP analysis photograph of No. 5 (example of the present invention) of Example 1.
Figure 3:
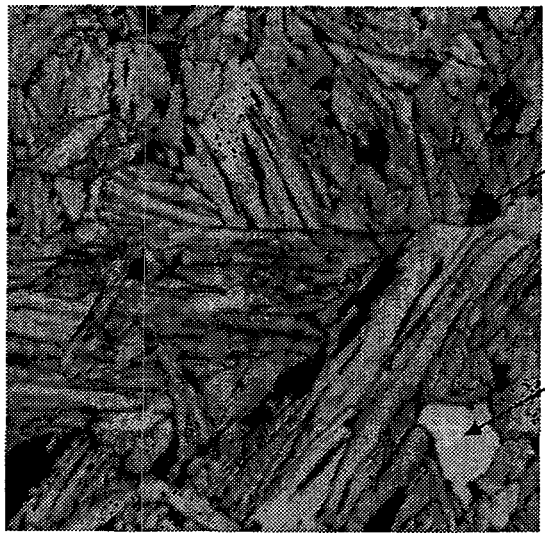

In the above-described EBPS analytical method, the portion other than the residual γ is sometimes colored green as a result of identification as the residual γ through mistake. Therefore, in the present invention, data having a confidence index (CI) of 0.2 (20%) or less (data having low reliability) are omitted by using software system manufactured by TexSEM Laboratories Inc. for the purpose of detecting the residual γ with high accuracy. FIG. 3 is an EBSP photograph of No. 5 (examples of the present invention) of Table 2, in which FIG. 3(*a*) is a photograph of EBSP without any processing and FIG. 3(*b*) is a photograph of EBSP after omitting data having CI of 0.2 or less. It is apparent that, in FIG. 3(*b*), the residual γ having low reliability of the red-colored portion (residual γ) in FIG. 3(*a*) is colored black and omitted by comparing FIG. 3(*a*) with FIG. 3(*b*).

As described above, the number of residual γ blocks in the red-colored portion, after omitting the residual γ having CI of 0.2 or less, is measured with respect to each measuring region (about 15×15 μm) at four positions in total, and the resulting mean value is defined as a "mean number of residual γ blocks".

In the present invention, the mean number of residual γ blocks calculated as described above is 20 or more. To secure more excellent formability (particularly stretch-flangeability), the larger the mean number of residual γ blocks, the better, and preferably 25 or more.

To control the mean number of residual γ blocks within the above range, as described hereinafter, a method for a heat treatment while controlling a slab temperature (SRT) at the starting of hot rolling to a higher temperature than that of the prior art using a Nb-added steel containing Nb added positively therein is effective and is most recommended taking account of the cost and productivity. In the present invention, this method is not necessarily limited and the mean number of the residual γ blocks can also be controlled within the above range. Specific examples thereof include a method in which a Nb-free steel not containing Nb therein (basic components in the steel satisfy the scope of the present invention) and the hot rolling step is carried out in the same manner as in case of the prior art (therefore, a slab temperature SRT at the starting of hot rolling is controlled within the same range as that in case of the prior art, for example, about 1050 to 1150° C.) and also a cold rolling ratio is set to the value more than that in case of the prior art (more than about 75%); a method in which the above Nb-free steel is used and the hot and cold rolling steps are carried out in the same manner as in case of the prior art and also the steel is annealed at lowered austempering temperature for a long time; and a method in which the above Nb-free steel is used and the hot rolling step is carried out in the same manner as in case of the prior art, while the cold rolling ratio is set to a high value and also the steel is annealed at lowered austempering temperature for a long time. We have already confirmed by examples (reference examples) described hereinafter that the mean number of fine residual γ blocks can be controlled to 20 or more by these methods.

Polygonal Ferrite: 30% or Less (Containing 0%)

As described above, the present invention improves elongation and stretch-flangeability of a high-strength steel sheet and also suppresses creation of polygonal ferrite to further improve stretch-flangeability by making a TRIP steel that consists mainly of bainitic ferrite as a matrix structure and contains fine residual austenite. Therefore, the smaller the proportion of the polygonal ferrite, the better. In the present invention, an upper limit of the proportion of the polygonal ferrite should be controlled within 30%, preferably within 20%, and most preferably to 0%.

Other Phase: Pearlite, Bainite, Martensite (Containing 0%)

The steel sheet of the present invention may be constituted either from only the structures described above (namely, a composite structure of bainitic ferrite and residual γ or a composite structure of bainitic ferrite, residual γ and polygonal ferrite), or may contain other structure (pearlite, bainite and martensite) that may remain in the manufacturing process of the present invention to such an extent that the effect of the present invention is not compromised. However, the smaller the proportion of these structures, the better. It is recommended that the total proportion is controlled within 10% (more preferably within 5%).

Now the essential components of the steel sheet of the present invention will be described. Hereinafter concentrations of components are all given in terms of mass percentage.

C: 0.10 to 0.28%

C is an essential element for ensuring high strength and maintaining residual γ. Particularly it is important to contain a sufficient content of C in the γ phase, so as to maintain the desired γ phase to remain even at the room temperature. In order to make use of this effect, it is necessary to contain 0.10% or more C content, preferably 0.12% or more and more preferably 0.15% or more. In order to ensure weldability, however, C content should be controlled to 0.28% or less, preferably 0.25% or less, more preferably 0.23% or less, and still more preferably 0.20% or less.

Si: 1.0 to 2.0%

Si has an effect of suppressing the residual γ from decomposing and carbide from being created, and is also effective in solid solution strengthening. In order to make full use of this effect, it is necessary to contain Si in a concentration of 1.0% or more, preferably 1.2% or more. However, excessive content of Si does not increase the effect beyond saturation and leads to a problem such as hot rolling embrittlement. Therefore, the concentration is controlled within an upper limit of 2.0%, preferably within 1.8%.

Mn: 1.0 to 3.0%

Mn is an element required to stabilize γ and obtain the desired level of residual γ. In order to make full use of this effect, it is necessary to contain Mn in a concentration of 1.0% or more, preferably 1.3% or more, and more preferably 1.6% or more. However, containing Mn in a concentration more than 3.0% causes adverse effects such as cast cracking. The concentration is preferably controlled within 2.5%.

Nb: 0.03 to 0.10%

As described above, the steel sheet of the present invention is characterized in that balance between tensile strength and stretch-flangeability is remarkably enhanced by refining the residual γ. In order to make full use of this effect, Nb is an important component. A mechanism for refining the residual γ by the addition of Nb is not clear, but is considered as follows. Nb is known as an element having the effects of enhancing precipitation and refining the structure. In the present invention, since the slab temperature (SRT) at the starting of hot rolling is controlled to a temperature higher than that in case of the method of the prior art, thereby allowing Nb to completely enter into a solid solution, the above effect is fully exerted to obtain a hot rolled steel sheet wherein a lot of fine Nb-based carbides (NbC: NbMoC formed with Mo to be optionally added in the steel) are precipitated in the polygonal ferrite (or bainite) structure during the hot rolling step (hot rolling→winding up). Even in case a cold rolled steel sheet is formed by cold rolling after hot rolling, fine carbides are remained. As a result, in case ferrite is reversely transformed into austenite by heating to a temperature above Ar3 point during the subsequent annealing or plating step, desired fine residual γ may be obtained.

In order to make full use of the effect of refining the residual γ by the addition of Nb, Nb is added in concentration of 0.03% or more, preferably 0.04% or more, and more preferably 0.05% or more. However, the effect described above reaches saturation even when Nb is added in excessive concentration, resulting in economical disadvantage. Therefore, an upper limit is set to 0.1%.

Al: 0.5% or Less

A high concentration of Al leads to higher likelihood of the polygonal ferrite to be created, thus making it difficult to improve the stretch-flangeability enough. Also Al has the effect of increasing A3 point and productivity is lowered. In order to suppress the creation of polygonal ferrite and improve the stretch-flangeability, it is effective to decrease the Al content, which is controlled to 0.5% or less, preferably to 0.2% or less, and more preferably to 0.1% or less, according to the present invention.

P: 0.15% or Less

P is an element that is effective to obtain the desired residual γ and to increase the strength, and may therefore be contained. However, an excessive concentration of P adversely affects the workability. Thus the concentration of P is controlled to 0.15% or less, and preferably within 0.1%.

S: 0.02% or Less

S forms sulfide inclusion such as MnS that initiates crack and adversely affects the workability of the steel. Therefore, concentration of S is controlled within 0.02% and preferably within 0.015%.

While the steel of the present invention includes the elements described above as the fundamental components with the rest substantially consisting of iron, the following elements may be contained as impurities, for example, N (nitrogen) and 0.01% or less of O (oxygen), introduced by the stock material, tooling and production facilities. Excessively high content of N results in the precipitation of much nitride which may lead to lower ductility. Thus the content of N should be controlled to 0.0060% or less, preferably 0.0050% or less and more preferably 0.0040% or less. Although the content of N is preferably as low as possible, lower limit will be set to about 0.0010% in consideration of the practical possibility of reduction in an actual process.

The following elements may be added to such an extent that does not compromise the effect of the present invention.

At Least One Selected from Mo: 1% or Less (More than 0%), Ni: 0.5% or Less (More than 0%) and/or Cu: 0.5% or Less (More than 0%)

These elements are effective in strengthening the steel and stabilizing and ensuring the predetermined amount of residual austenite. These elements may be used alone or in combination. The addition of Mo among these elements is effective to achieve desired characteristics because fine Nb-based carbides (NbMoC) are created during the hot rolling step and the effect of reefing the residual austenite is further accelerated. In order to make full use of this effect, it is recommended to add Mo in concentration of 0.05% or more (preferably 0.1% or more), Ni in concentration of 0.05% or more (preferably 0.1% or more) and Cu in concentration of 0.05% or more (preferably 0.1% or more). However, the effects described above reach saturation when they are added in excessive concentrations, resulting in economical disadvantage. Therefore, an upper limit was set to 1.0% Mo. 0.5% Ni and 0.5% Cu. It is more preferable to add 0.8% or less of Mo, 0.4% or less of Ni and 0.4% or less of Cu.

Ca: 0.003% or Less (More than 0%) and/or REM: 0.003% or Less (More than 0%)

Ca and REM (rare earth element) are effective in controlling the form of sulfide in the steel and improve the workability of the steel, and these elements can be used alone or in combination. Sc, Y, lanthanoid and the like may be used as the rare earth element in the present invention. In order to achieve the effect described above, it is recommended to add each of these elements in concentration of 0.0003% or more (preferably 0.0005% or more). However, the effects described above reach saturation when the concentration exceeds 0.003%, resulting in economical disadvantage. It is more preferable to keep the concentration within 0.0025%.

Ti: 0.1% or Less (More than 0%) and/or V: 0.1% or Less (More than 0%)

Similar to Nb, these elements have the effects of enhancing precipitation and refining the structure (the degree is considered to be inferior as compared with Nb), and are effective in strengthening the steel. In order to make full use of these effects, it is recommended to add Ti in concentration of 0.01% or more (preferably 0.02% or more) and V in concentration of 0.01% or more (preferably 0.02% or more). However, the effects described above reach saturation when the concentration of any of these elements exceeds 0.1%, resulting in economical disadvantage. It is more preferable to add 0.08% or less of Ti and 0.08% or less of V.

Typical method for manufacturing the steel sheet of the present invention will now be described.

According to the manufacturing method of the present invention, the steel material having the composition described above is subjected to a hot rolling step, a cold rolling step and an annealing step or a plating step. The point in the method is to properly control the slab temperature (SRT) at the starting of hot rolling in the hot rolling step and the heating temperature (soaking temperature) in the annealing or plating step. The respective steps will now be described.

Hot Rolling Step

The present invention is first characterized in that the slab temperature (SRT) at the starting of hot rolling is controlled to the temperature ranging from 1250 to 1350° C., that is higher than that in the prior art, so as to obtain the desired "refined residual γ". It is considered that Nb normally begins to enter into a solid solution of the steel by heating at the temperature of about 1100° C. Normally, SRT has conventionally been controlled to the temperature within a range from 1100 to 1150° C., at most 1200° C., in consideration of the manufacturing cost. However, the following fact has become apparent as a result of the research of the present inventors. That is, it is impossible to allow Nb to completely enter into the solid solution at the temperature within the above range, and thus the effect of refining the residual γ due to the addition of Nb can not be fully exerted and characteristics ($TS \times \lambda \geq 40{,}000$) of the desired stretch-flangeability ca not be attained (see examples described hereinafter). Therefore, SRT is controlled within a range from 1250 to 1350° C. in the present invention. An upper limit of SRT was defined to 1350° C. because the slab is deteriorated when SRT is too high. SRT is preferably 1270° C. or higher and 1330° C. or lower.

As described above, the hot rolling step is characterized by controlling SRT to higher temperature. Heat treatment conditions other than SRT are not specifically restricted and conventional conditions may be properly selected. Specifically, the finish rolling end temperature (FDT) is controlled to the temperature above Ar3 point and cooling is conducted at a mean cooling rate of about 3 to 50° C./sec. (preferably 20° C./sec.) and also the resulting hot rolled steel sheet is wound up at the temperature within a range from about 500 to 600° C.

Cold Rolling Step

After subjecting to the hot rolling step, the steel sheet is then cold rolled. The cold rolling reduction is not specifically limited and may be normally from about 30 to 75%. To prevent non-uniform recrystallization, it is recommended to control the cold rolling reduction to 40% or more and 70% or less, preferably.

Annealing or Plating Step

This step is important to finally obtain the desired structure (TBF steel having a structure constituted mainly from bainitic ferrite, as a matrix structure, containing the residual γ). The present invention is characterized in that the desired bainitic ferrite is obtained by controlling the soaking temperature (T1 described hereinafter) and the austempering temperature (T2 described hereinafter).

Specifically, it is recommended that:

(i) The temperature is maintained (soaked) at A3 point or higher (T1) for 10 to 200 seconds;

(ii) The temperature is lowered from T1 to bainite transformation temperature range (T2: about 450 to 300° C.) under control to prevent the ferrite transformation and pearlite transformation from occurring, at a mean cooling rate (CR) of 10° C./sec. or higher; and (iii) The temperature is maintained in the temperature range described above (T2) for 180 to 600 seconds (austempering treatment).

Soaking at the temperature of A3 point or higher (T1) is effective in completely melting carbide and forming the desired residual γ, and is also effective in forming bainitic ferrite in the cooling step after soaking. Duration of maintaining the temperature (T1) is preferably set in a range from 10 to 200 seconds. When the duration is shorter, the effect described above cannot be obtained enough, and longer duration results in the growth of coarse crystal grains. The duration is more preferably from 20 to 150 seconds.

Then the temperature is lowered from T1 to the bainite transformation temperature range (T2: about 450 to 320° C.) at a mean cooling rate (CR) of 10° C./sec. or higher, preferably 15° C./sec. or higher and more preferably 20° C./sec. or higher, under control to prevent the pearlite transformation from occurring. Specified amount of bainitic ferrite can be formed by controlling the mean cooling rate within the range described above through air cooling, mist cooling or by the use of water-cooled roll in the cooling step. While the mean cooling rate is desired to be as fast as possible and specific upper limit is not set, it is recommended to set the mean cooling rate at a proper level by taking the actual operation into consideration.

It is preferable to continue the control of cooling rate until the temperature reaches the bainite transformation temperature range (T2: about 450 to 320° C.), because it is difficult to generate residual γ and achieve satisfactory elongation when the control is concluded prematurely at a temperature higher than the temperature range (T2) and the steel is left to cool down very slowly. It is also not desirable to maintain the cooling rate described above till a temperature lower than the temperature range described above is reached, since it makes it difficult to generate residual γ and achieve satisfactory elongation property.

After cooling down, it is preferable to maintain the temperature in the temperature range described above (T2) for 60 to 600 seconds. Maintaining the temperature in the range described above for 60 seconds enables it to concentrate C in the residual γ efficiently in a short period of time and obtain stable residual γ in sufficient amount, thus causing the TRIP effect by the residual γ to develop reliably. The temperature is maintained more preferably for 120 seconds or more, and further most preferably for 180 seconds or longer. When this duration exceeds 600 seconds, the TRIP effect by the residual γ cannot be achieved sufficiently, and therefore the duration is preferably limited within 480 seconds.

In the practical manufacturing process, the annealing process described above can be carried out easily by employing a continuous annealing facility. The heat treatment described above may be carried out by heating and cooling by means of continuous annealing facility (CAL, actual facility), continuous alloying galvanizing facility (CGL, actual facility), CAL simulator, salt bath or the like.

There is no restriction on the method of cooling down the steel after maintaining the temperature described above to the room temperature, and water cooling, gas cooling, air cooling or the like may be employed. Plating or alloying treatment may also be carried out to such an extent that deviation from the desired metal structure and/or other adverse effect to the feature of the present invention would not be caused. Such a steel sheet is also included in the present invention. In case cold rolled sheet is plated with zinc by hot dipping, the heat treatment process may be replaced by the plating process by setting the plating conditions so as to satisfy the heat treatment conditions.

Now the present invention will be described in detail below by way of examples. It is understood, however, that the present invention is not limited by these examples, and various modifications that do not deviate from the spirit of the present invention described herein are all within the scope of the present invention.

EXAMPLES

Example 1

Investigation on Composition

In this example, steel specimens A to J having the compositions shown in Table 1 (rest of the composition consists of Fe and inevitable impurities) was made by melting to obtain a slab that was subjected to hot rolling. The slab was hot rolled at SRT of 1300° C. and FDT of 900° C. and then wound up at 500° C. to obtain a hot rolled steel sheet having a thickness of 2.4 mm. The hot rolled steel sheet was pickled to remove scales and then cold rolled (rolling reduction: 50%) to obtain a cold rolled steel sheet having a thickness of 1.2 mm.

The resulting cold rolled sheet was subjected to heat treatment by using a CAL simulator. Specifically, the steel sheet was maintained in a temperature range of about 900° C. (T1) for a duration of 60 seconds, cooled forcibly at a cooling rate (CR) of 20° C./s to about 400° C. (T2), maintained in a temperature range of about 400° C. (T2) for about 4 minutes (240 seconds), and was then cooled down to the room temperature before being wound up.

Metal structures of the steel sheets made as described above were observed and the mean number of the residual γ blocks was calculated by the method described above.

A tensile test was conducted by using JIS No. 5 test piece to measure tensile strength (TS) and elongation [total elongation (El)].

Stretch-flangeability test was also conducted to evaluate stretch-flangeability (λ). The stretch-flangeability test was conducted by using a disk-shaped test piece measuring 100 mm in diameter and 1.0 to 1.6 mm in thickness. Specifically, after punching through a hole 10 mm in diameter, the disk was placed with the burred surface facing upward and was reamed by means of a 60° conical punch, thereby expanding the hole. Then the hole expanding ratio (λ) at the time when a crack penetrated through was measured (Japan Steel Industry Association Standard JFST 1001).

The results are shown in Table 2. In Table 2, "n (number)" means a mean number of the residual γ blocks present per predetermined area.

TABLE 1

| Steel | Composition (mass %) | | | | | | | | | $A_3$ transformation |
|---|---|---|---|---|---|---|---|---|---|---|
| type No. | C | Si | Mn | P | S | Al | N | Nb | Mo | point (° C.) |
| A | 0.050 | 1.50 | 1.51 | 0.02 | 0.003 | 0.030 | 0.0040 | 0.04 | 0.22 | 893 |
| B | 0.110 | 1.51 | 1.50 | 0.02 | 0.003 | 0.030 | 0.0040 | 0.05 | 0.20 | 871 |

TABLE 1-continued

| Steel type No. | Composition (mass %) C | Si | Mn | P | S | Al | N | Nb | Mo | $A_3$ transformation point (° C.) |
|---|---|---|---|---|---|---|---|---|---|---|
| C | 0.200 | 1.51 | 1.51 | 0.02 | 0.003 | 0.030 | 0.0040 | | | 841 |
| D | 0.210 | 1.51 | 1.50 | 0.02 | 0.003 | 0.030 | 0.0040 | 0.02 | 0.10 | 843 |
| E | 0.200 | 1.50 | 1.51 | 0.02 | 0.003 | 0.030 | 0.0040 | 0.05 | | 841 |
| F | 0.210 | 1.52 | 1.49 | 0.02 | 0.003 | 0.030 | 0.0040 | 0.05 | 0.21 | 847 |
| G | 0.200 | 0.40 | 1.51 | 0.02 | 0.003 | 0.030 | 0.0040 | 0.06 | 0.20 | 798 |
| H | 0.250 | 1.50 | 1.60 | 0.02 | 0.003 | 0.030 | 0.0040 | 0.05 | 0.20 | 834 |
| I | 0.200 | 1.50 | 2.10 | 0.02 | 0.003 | 0.030 | 0.0040 | 0.05 | | 823 |
| J | 0.300 | 1.51 | 1.50 | 0.02 | 0.003 | 0.030 | 0.0040 | 0.05 | 0.20 | 828 |

TABLE 2

| Experiment No. | Steel type No. | Structure (Proportion %) PF | (1) other than PF | (2) Residual γ | BF (1) − (2) | n (number) | Characteristics TS (MPa) | El (%) | λ (%) | TS × El | TS × λ |
|---|---|---|---|---|---|---|---|---|---|---|---|
| 1 | A | 88 | 12 | 2 | 10 | 1 | 681 | 23.3 | 78 | 15867 | 53118 |
| 2 | B | 25 | 75 | 7 | 68 | 22 | 768 | 33.1 | 77 | 25421 | 59136 |
| 3 | C | 23 | 77 | 13 | 64 | 16 | 797 | 25.2 | 45 | 20084 | 35865 |
| 4 | D | 18 | 82 | 12 | 70 | 15 | 841 | 23.2 | 42 | 19511 | 35322 |
| 5 | E | 10 | 90 | 10 | 80 | 35 | 803 | 26.7 | 55 | 21440 | 44165 |
| 6 | F | 0 | 100 | 12 | 88 | 41 | 890 | 24.6 | 56 | 21894 | 49840 |
| 7 | G | 12 | 88 | 1 | 87 | 0 | 940 | 14.0 | 23 | 13160 | 21620 |
| 8 | H | 0 | 100 | 14 | 86 | 45 | 995 | 26.0 | 45 | 25870 | 44775 |
| 9 | I | 0 | 100 | 12 | 88 | 43 | 1066 | 25.6 | 54 | 27290 | 57864 |
| 10 | J | 27 | 73 | 18 | 55 | 49 | 1141 | 22.0 | 25 | 25102 | 28525 |

The results shown in Table 2 can be interpreted as follows.

Nos. 2, 5 to 6 and 8 to 9 all in Table 2 are cold rolled steel sheets obtained by subjecting steel materials (steel type Nos, B, E to F and H to I in Table 1) satisfying the components in the steel defined in the present invention to a heat treatment under the conditions defined in the present invention, and are remarkably excellent in balance between tensile strength and elongation as well as balance between tensile strength and stretch-flangeability.

Other examples, where some of the requirements of the present invention is not satisfied, have drawbacks as described below.

No. 1 is an example made of a steel of type A having small C content, where the predetermined amount of residual γ could not be formed and the resulting structure is constituted mainly from polygonal ferrite with less bainitic ferrite, resulting in poor balance between tensile strength and elongation.

No. 10 is an example made of a steel of type J having large C content, resulting in poor stretch-flangeability and poor balance between strength and stretch-flangeability.

No. 7 is an example made of a steel of type G having small Si content, and the predetermined amount of the residual γ can not be obtained and the mean number of the residual γ blocks is 0, resulting in poor balance between tensile strength and elongation as well as poor balance between tensile strength and stretch-flangeability.

No. 3 is an example made of a steel of type C free from Nb and No. 4 is an example made of a steel of type D having small Nb content. In both examples, the proportion of the residual γ satisfies the scope of the present invention, however, the desired mean number of fine residual γ blocks is not attained, resulting in poor balance between tensile strength and stretch-flangeability. Particularly in No. 4, balance between tensile strength and elongation is inferior to the target level (20,000 or more) of the present invention.

Next, formed products made of steel sheet No. 6 in Table 2 and a comparative steel sheet (conventional 590 MPa class high tension steel sheet) were evaluated in crush resistance and impact resistance in order to examine the properties as formed product.

<Crush Resistance Test>

Figure 4:
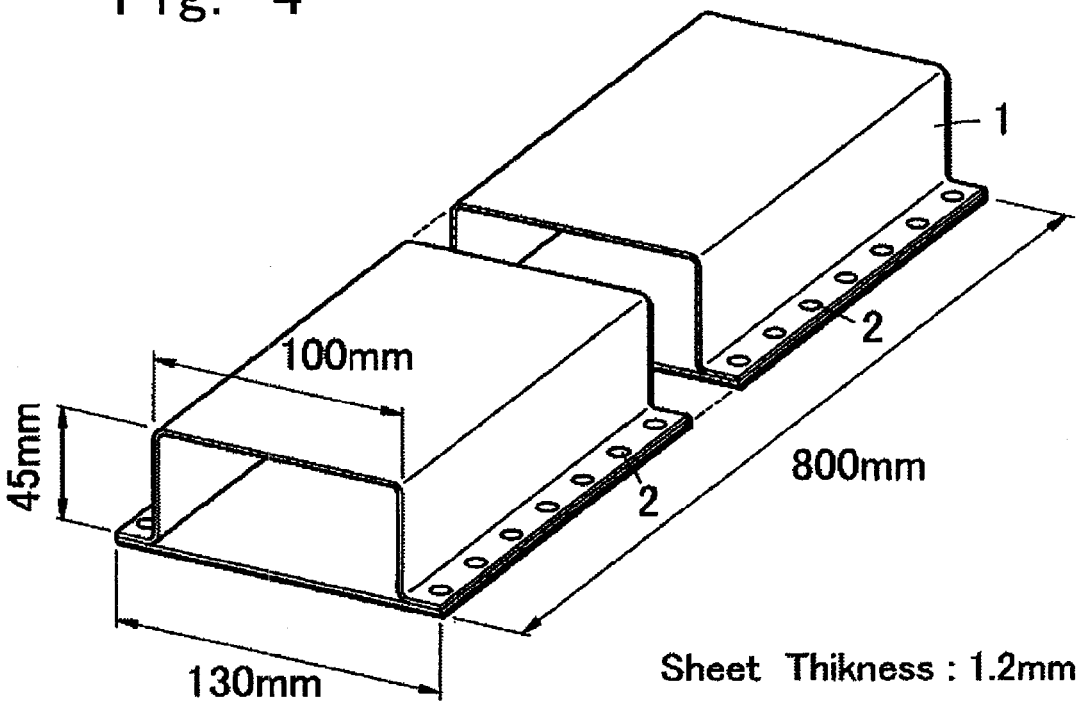
FIG. 4 is a schematic perspective view of a member for the crush resistance test in Example.
Figure 5:
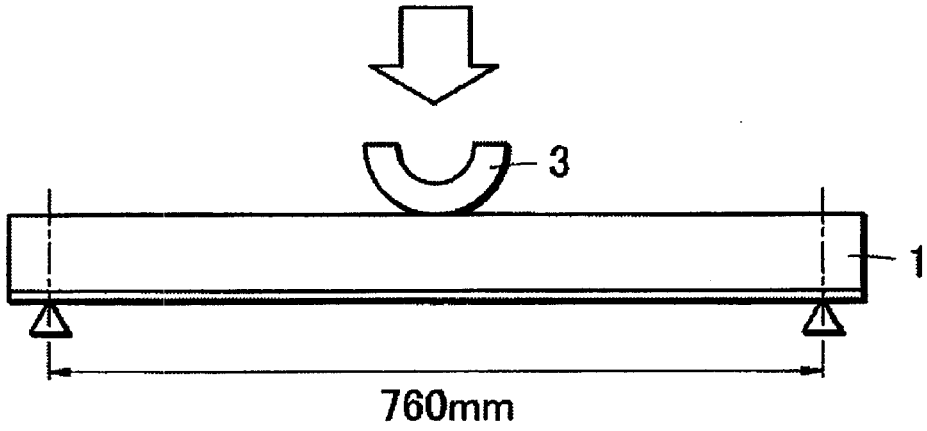
FIG. 5 is a schematic side view showing the way in which the crush resistance test is conducted in Example.

A member 1 as shown in FIG. 4 (hat channel member) was made of No. 6 in Table 2 or the comparative steel sheet. A crush resistance test for the members was conducted in the following way. Spot welding was performed in 3.5 mm pitch for the spot welding positions 2 in the member 1, as shown in FIG. 4, wherein an electrode of 6 mm diameter was used and a current 0.5 kA lower than the splash current was applied. Then, as shown in FIG. 5, a metal mold was pushed from above onto the center of the member 1 in the longitudinal direction and the maximum load was obtained. At the same time, absorbed energy was obtained according to the area in load-displacement diagram. The results are shown in Table 3.

TABLE 3

| No. | Used Steel Sheet TS (MPa) | EL (%) | Retained γ (areal ratio %) | Test Results Maximum Load (kN) | Absorbed Energy (kJ) |
|---|---|---|---|---|---|
| 6 | 890 | 24.6 | 12 | 8.4 | 0.45 |
| Comparative Steel Sheet | 613 | 22 | 0 | 5.7 | 0.33 |

The table 3 shows that the member made of No. 6 steel sheet has a higher load and higher energy absorption property than one made of a conventional low strength steel sheet and that it has an excellent crush resistance.

<Impact Resistance Test>

Figure 6:
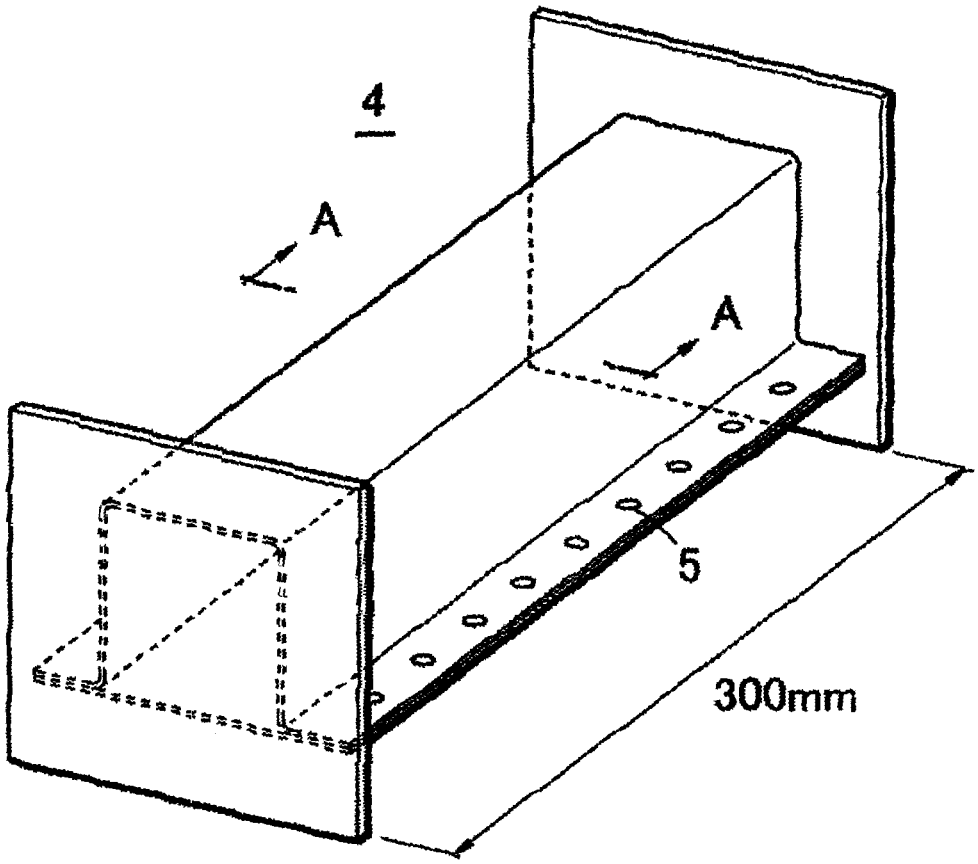
FIG. 6 is a schematic perspective view of a member for the impact resistance test in Example.
Figure 7:
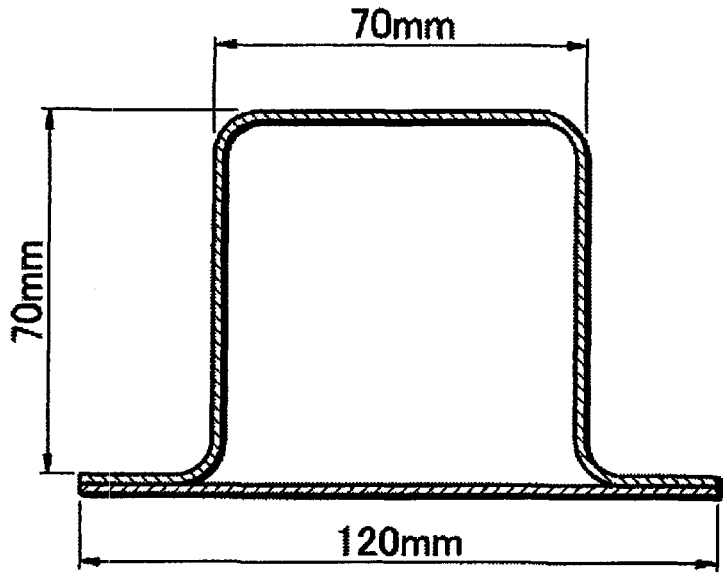
FIG. 7 is a sectional view at A-A in FIG. 6.
Figure 8:
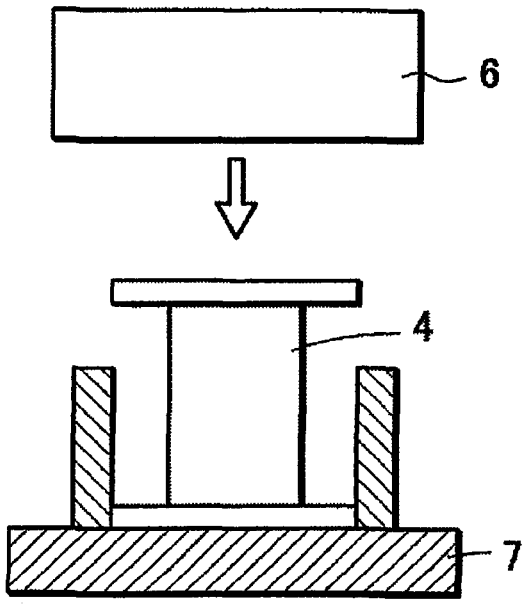
FIG. 8 is a schematic side view showing the way in which the impact resistance test is conducted in Example.

A member 4 as shown in FIG. 6 (hat channel member) was made of No. 6 in Table 2 or the conventional steel sheet. An impact resistance test for the member was conducted in the following way. FIG. 7 is a sectional view of the member 4 at A-A in FIG. 6. Spot welding was performed for the spot welding positions 5 in the member 4. Then, as schematically shown in FIG. 8, the member 4 was installed on a base 7 and a hammer 6 (110 kg mass) was dropped from a position 11 m high above the member 4. Absorbed energy until the member was deformed (in the height direction) by 40 mm was obtained. The results are shown in Table 4.

TABLE 4

| | Used Steel Sheet | | | Test Results |
|---|---|---|---|---|
| No. | TS (MPa) | EL (%) | Retained γ (areal ratio %) | Absorbed Energy (kJ) |
| 6 | 890 | 24.6 | 12 | 4.41 |
| Comparative Steel Sheet | 613 | 22 | 0 | 3.56 |

Table 4 shows that the member made of No. 6 steel sheet has a higher energy absorption property than one made of a conventional low strength steel sheet and that it has excellent impact resistance.

Example 2

Investigation on Heat Treatment Conditions

In this example, an influence of heat treatment conditions on the structure and mechanical characteristics was investigated in cold rolled steel sheets (Nos. 11 to 17) made of a steel of type F (steel of type that satisfies the scope of the present invention) in the same manner as in the method of Example 1, except that some of the heat treatment conditions does not satisfy the requirements of the present invention. The heat treatment conditions are the same as described in Example 1, except for alterations shown in Table 5. Specifically, No. 11 is an example made by changing the slab temperature SRT at the starting of hot rolling and Nos. 12 to 17 are examples made by changing the heat treatment conditions on annealing.

The results are also shown in Table 5. For reference, the results of No. 6 made of a steel of type F in Table 1 are also shown.

TABLE 5

| | | | Annealing | | |
|---|---|---|---|---|---|
| Experiment No. | Steel type No. | Hot rolling SRT (° C.) | Heating temperature T1 (° C.) | Cooling rate CR (° C./sec.) | Austempering temperature T2 (° C.) |
| 6*1 | F | 1300 | ≥$A_{c3}$ point | 20 | 400 |
| 11 | F | 1100*2 | ≥$A_{c3}$ point | 20 | 400 |
| 12 | F | 1300 | <$A_{c3}$ point*2 | 20 | 400 |
| 13 | F | 1300 | ≥$A_{c3}$ point | 20 | 500*2 |
| 14 | F | 1300 | ≥$A_{c3}$ point | 20 | 300*2 |
| 15 | F | 1300 | ≥$A_{c3}$ point | 2 | 400 |

| | Structure (Proportion %) | | | | | Characteristics | | | | |
|---|---|---|---|---|---|---|---|---|---|---|
| Experiment No. | PF | (1) other than PF | (2) Residual γ | BF (1) − (2) | n (number) | TS (MPa) | El (%) | λ (%) | TS × El | TS × λ |
| 6*1 | 0 | 100 | 12 | 88 | 41 | 890 | 24.6 | 56 | 21894 | 49840 |
| 11 | 0 | 100 | 11 | 89 | 16 | 868 | 23.4 | 37 | 20311 | 32116 |
| 12 | 56 | 44 | 13 | 31 | 8 | 809 | 27.6 | 27 | 22328 | 21843 |
| 13 | 12 | 88 | 2 | 86 | 1 | 921 | 15.1 | 18 | 13907 | 16578 |
| 14 | 0 | 100 | 0 | 100 | 0 | 945 | 14.4 | 14 | 13608 | 13230 |
| 15 | 45 | 55 | 11 | 44 | 5 | 802 | 26.6 | 12 | 21333 | 9624 |

*1Heat treatment conditions of Example 1 (the same conditions in Example 1) and the results of No. 6 (Table 2) are described.
*2This is a step that does not fall within the method of Example 1.

No. 11 is an example in which a slab temperature (SRT) at the starting of hot rolling is low such as 1100° C., and the mean number (n) of fine residual γ blocks decreases, resulting in drastically poor balance between tensile strength and stretch-flangeability.

No. 12 among Nos. 12 to 17 made by changing the heat treatment conditions on annealing is an example in which the heating temperature on annealing (soaking temperature: T1) is lower than the Ac3 point (820° C.), and the resulting structure is constituted mainly from polygonal ferrite, resulting in drastically poor balance between tensile strength and stretch-flangeability, similar to a conventional TRIP steel.

Nos. 13 and 14 are examples in which the transformation temperature on austempering treatment (T2) is high such as 500° C. or low such as 300° C., and the desired residual γ is not obtained, resulting in insufficient elongation and stretch-flangeability.

No. 15 is an example in which the cooling rate (CR) after heating in the annealing is low such as 2° C./sec., and the desire structure is not obtained because ferrite transformation and pearlite transformation occur, resulting in poor balance between strength and stretch-flangeability.

Example 3

Investigation on Other Manufacturing Methods

This reference example was carried out so as to demonstrates that, unlike Example 1 described above, even when using a Nb-free steel containing no Nb added therein (provided that the essential components in the steel satisfies the scope of the present invention), the mean number of the residual γ blocks can be controlled to 20 or more) and thus a high-strength cold rolled steel sheet having excellent formability can be obtained (by the way, the cold rolling reduction increases in this reference example).

Specifically, a steel material (steel type C in Table 1, that satisfies the components in the steel in the present invention) was subjected to a hot rolling step (SRT: 1150° C., FDT: 800° C., winding up temperature: 600° C.), a cold rolling step (cold rolling reduction: 80%) and an annealing step [of maintaining in a temperature range of about 900° C. for a duration of 120 seconds, cooling forcibly at a mean cooling rate of 20° C./s to about 400° C., and maintaining in the same temperature range for about 4 minutes (about 240 seconds) (austempering treatment)], and then cooled down to the room temperature before being wound up.

In the same manner as in Example 1, metal structures of the cold rolled steel sheets made as described above were observed and the mean number of the residual γ blocks was calculated, and also various mechanical characteristics were measured in the same manner.

As a result, it has been found that the above cold rolled steel sheets are TBF steel sheets, that are made constituted mainly from bainitic ferrite including the residual γ and satisfy the mean number of residual γ blocks of 20 or more, resulting in excellent formability, that is, the product of tensile strength and elongation is 20,000 or more and the product of tensile strength and stretch-flangeability is 40,000 or more.

What is claimed is:

1. A high-strength cold rolled steel sheet, which contains:
0.10 to 0.28% of C,
1.0 to 2.0% of Si,
1.0 to 3.0% of Mn, and
0.03 to 0.10% of Nb in terms of % by mass,
wherein the content of Al is controlled to 0.5% or less,
the content of P is controlled to 0.15% or less, and
the content of S is controlled to 0.02% or less,
and wherein residual austenite accounts for 5 to 20%,
bainitic ferrite accounts for 50% or more, and
polygonal ferrite accounts for 30% or less (containing 0%), of the entire structure,
and wherein a mean number of residual austenite blocks is 20 or more as determined when the random area (15 μm×15 μm) is observed by electron back scatter diffraction pattern.

2. The high-strength cold rolled steel sheet according to claim 1, which contains 0.05 to 0.10% of Nb.

3. The high-strength cold rolled steel sheet according to claim 1, further containing:
at least one of the group consisting of
1.0% or less (more than 0%) of Mo,
0.5% or less (more than 0%) of Ni, and
0.5% or less (more than 0%) of Cu.

4. The high-strength cold rolled steel sheet according to claim 1, further containing: at least one of the group consisting of
0.003% or less (more than 0%) of Ca, and
0.003% or less (more than 0%) of REM.

5. The high-strength cold rolled steel sheet according to claim 1, further containing: at least one of the group consisting of
0.1% or less (more than 0%) of Ti or
0.1% or less (more than 0%) of V.

6. The high-strength cold rolled steel sheet according to claim 1, wherein the content of C in the residual austenite is 0.8% or more.

7. The high-strength cold rolled steel sheet according to claim 1, wherein the bainitic ferrite accounts for 70% or more of the entire structure.

8. A plated steel sheet manufactured by plating the cold rolled steel sheet according to claim 1.

9. The high-strength cold rolled steel sheet according to claim 1, wherein TS×El is 20,000 or more, and TS×λ is 40,000 or more, wherein TS is tensile strength, in MPa; El is total elongation, in %; and λ is stretch-flangeability, in %.

10. The high-strength cold rolled steel sheet according to claim 1, wherein the mean number of residual austenite blocks is 25 or more.

11. The high-strength cold rolled steel sheet according to claim 1, wherein the bainitic ferrite accounts for 70% or more of the entire structure.

12. The high-strength cold rolled steel sheet according to claim 1, wherein the bainitic ferrite accounts for 80% or more of the entire structure.

13. The high-strength cold rolled steel sheet according to claim 1, wherein the polygonal ferrite accounts for 20% or less (containing 0%), of the entire structure.

14. The high-strength cold rolled steel sheet according to claim 1, wherein the polygonal ferrite accounts for 0% of the entire structure.

15. The high-strength cold rolled steel sheet according to claim 1, wherein the residual austenite accounts for 7 to 20%.

16. The high-strength cold rolled steel sheet according to claim 1, wherein the residual austenite accounts for 7 to 17%.

* * * * *